United States Patent [19]

Sohara

[11] Patent Number: 4,980,000

[45] Date of Patent: Dec. 25, 1990

[54] NITROSTARCH EMULSION EXPLOSIVES PRODUCTION PROCESS

[75] Inventor: Joseph A. Sohara, Walnutport, Pa.

[73] Assignee: Atlas Powder Company, Dallas, Tex.

[21] Appl. No.: 466,509

[22] Filed: Jan. 17, 1990

[51] Int. Cl.[5] ..... D03D 23/00

[52] U.S. Cl. ..... 149/109.6; 149/2; 149/38; 149/58; 149/59; 149/62; 149/108

[58] Field of Search ..... 149/2, 109.6, 108, 58, 149/59, 38, 62

[56] References Cited

U.S. PATENT DOCUMENTS

| | | | |
|---|---|---|---|
| 2,461,582 | 2/1949 | Wright et al. | 260/467 |
| 2,485,855 | 10/1949 | Blomquist et al. | 260/467 |
| 2,678,946 | 5/1954 | Blomquist et al. | 260/467 |
| 3,423,256 | 1/1969 | Griffith | 149/2 |
| 3,711,345 | 1/1973 | Tomic | 149/22 |
| 3,899,374 | 8/1975 | Sylkhouse | 149/2 |
| 4,352,699 | 10/1982 | Zeigler, Jr. | 149/109.6 |
| 4,371,408 | 2/1983 | Fillman | 149/21 |
| 4,381,958 | 5/1983 | Howard | 149/19.8 |
| 4,383,873 | 5/1983 | Wade et al. | 149/2 |
| 4,450,110 | 5/1984 | Simmons et al. | 260/349 |
| 4,457,791 | 7/1984 | Gill et al. | 149/19.3 |
| 4,522,756 | 6/1985 | Schack et al. | 260/349 |
| 4,523,967 | 6/1985 | Cartwright | 149/2 |
| 4,664,729 | 5/1987 | Rehman | 149/21 |
| 4,726,919 | 2/1988 | Kristofferson et al. | 264/33 |
| 4,761,250 | 8/1988 | Frankel et al. | 260/349 |
| 4,853,157 | 8/1984 | Stiff | 558/484 |

FOREIGN PATENT DOCUMENTS 0129995 2/1985 European Pat. Off. .

OTHER PUBLICATIONS

U.S. Statutory Invention Registration No. H448 to Farncomb, et al. (Class 149/104) published Mar. 1, 1988, filed Jul. 6, 1988.

"Zeitschrift fur das gesamte Schiefb und Sprengstoffwese", Investigation of Extraction and Characteristics of Nitrostarches (and English Translation thereof), by J. Hackel and T. Urbanski, Warsaw, Poland, Oct. 1933, Issue Nos. 10, 11, 12.

*Primary Examiner*—Stephen J. Lechert, Jr.

*Attorney, Agent, or Firm*—Richards, Medlock & Andrews

[57] ABSTRACT

The present invention provides a method for producing a water-in-oil emulsion and the emulsion explosives therefrom containing nitrostarch by nitrating starch with an excess of a nitrating agent, treating the reaction mixture thereof with anhydrous ammonia to form a solution of water, dissolved ammonium nitrate, and nitrostarch, and thereafter combining the aqueous solution with a carbonaceous fuel phase and emulsifier to form a water-in-oil emulsion. The explosive is provided, preferably, by the distribution of voids throughout the water-in-oil emulsion to render it detonable. The invention is also applicable to the production of melt-in-fuel explosive compositions and water-gel explosives.

48 Claims, No Drawings

NITROSTARCH EMULSION EXPLOSIVES PRODUCTION PROCESS

TECHNICAL FIELD

The present invention relates to the production and manufacture of explosive compositions and in particular, a nitration and emulsification process to produce a water-in-oil emulsion which contains nitrostarch and the water-in-oil explosive compositions resulting therefrom. The invention is also applicable to the production of melt-in-fuel explosive compositions and water-gel explosives.

BACKGROUND ART

Nitration of starch to produce nitrostarch is known in the art. Typically, the known processes involve nitration of starch in a solution of nitric acid plus another strong acid such as sulfuric acid, perchloric acid, selenic acid or hydrofluoric acid. Mixed acid systems have been used industrially because they provide the best nitration reaction time, the best yield and the best chemical efficiency. The mixtures of acids are used in order to produce high $NO_2^+$ concentrations to achieve complete nitration. Sulfuric acid is the most frequently used co-acid with nitric acid because it is highly effective and inexpensive.

Highest concentrations of $NO_2^+$ are known to occur at essentially equal molar amounts of nitric acid and sulfuric acid. As reported by Urbansky, while a reduction in the amount of nitric acid used results in decreased yields of product, it is not advantageous to decrease the amount of secondary acid, as this results in the increased production of unwanted by-products. In such reactions, starches are nitrated in the presence of the combined acid medium, which results in the production of nitrostarch. Usually these acid mixtures also contain water and, additionally, some water is typically formed during the nitration process. The nitrostarch produced is relatively insoluble in the combined acid medium and can be easily separated by drowning with water. However, prior commercial processes then require the drying of the nitrostarch from the associated water. While this required drying process yields dry nitrostarch, the drying process is expensive. Moreover, handling the resulting dry nitrostarch is quite dangerous. Typically, a small quantity of water is left in the product to reduce the handling hazards of completely dry nitrostarch.

The incorporation of nitrostarch into water-in-oil emulsions by conventional processes requires the separate production of the nitrostarch followed by the separate step of adding the nitrostarch to the emulsion. The production of water-in-oil emulsions and the explosive compositions therefrom and water-gel explosives by such conventional processes is both costly and dangerous because it requires the separate production and drying of the nitrostarch and requires the handling of dried nitrostarch. Thus, there has been a need to provide a process by which nitrostarch can be incorporated into water-in-oil emulsions and the explosives resulting therefrom and water-gel explosives economically and safely.

SUMMARY OF THE INVENTION

The present invention provides for a process for the manufacture of a water-in-oil emulsion containing nitrostarch and the production of explosive compositions therefrom. The present invention is also useful for the manufacture of water-gel explosive compositions. The process involves contacting starch with an excess of concentrated nitrating agent, preferably concentrated nitric acid, and admixing the two to react the starch and nitric acid to provide a mixture of nitrostarch and nitric acid. In one embodiment of the present invention, this mixture is then treated with anhydrous ammonia to produce a solution containing nitrostarch, ammonium nitrate and water. In a preferred embodiment, an amount of water is added to the nitration mixture to precipitate the nitrostarch from the nitrating media. The amount of water should be approximately equal in weight to the amount of excess nitric acid remaining after completion of the nitration. The dilute nitric acid solution thus formed, containing the nitrostarch from the nitration reaction, is then treated with a suitable neutralizing agent such as anhydrous ammonia, ammonium hydroxide, or alkali and alkaline earth metal carbonates including sodium carbonate, calcium carbonate or other suitable neutralizing agent, to produce a solution containing inorganic oxidizer salts, water and nitrostarch. This solution may then be concentrated, if desired, to reduce the water content and then emulsified with a carbonaceous fuel phase and emulsifier to form a water-in-oil emulsion matrix. Thereafter, the emulsion matrix may be further treated to produce explosive products. The matrix may be added to solid ammonium nitrate or other solid oxidizer, or the emulsion preferably is sensitized by providing voids distributed throughout the emulsion by utilization of closed cell void containing material such as glass or Saran microballoons. In the case of water-gel explosive compositions, the solution containing the inorganic oxidizer salts, nitrostarch and, water is mixed with a fuel component and thereafter, a thickening agent is added. The mixture is sensitized, forming a water-gel explosive composition.

Preferably, the amount of nitric acid utilized with the nitrostarch is sufficient to produce the desired amount of nitrostarch and also to produce the desired amount of inorganic oxidizer salts upon reaction with ammonium hydroxide, anhydrous ammonia or other suitable neutralizing agent. The process may also include the step of dissolving additional ammonium nitrate or other inorganic oxidizer salts such as calcium nitrate or sodium nitrate in the aqueous phase containing nitrostarch and the inorganic oxidizer salts.

DETAILED DESCRIPTION

The present invention provides a method for producing a water-in-oil emulsion containing nitrostarch and the emulsion explosives resulting therefrom The present invention is also useful in the manufacture of water-gel explosive compositions. In the manufacture of water-gel explosives, the procedure to produce the nitrostarch and inorganic oxidizer salts would be the same as in the case of a water-in-oil emulsion composition; however, in the case of water-gel explosives, the solution containing nitrostarch, inorganic oxidizer salts and water would be combined with a fuel component and gelled using a thickening agent known in the art, e.g., guar gum, rather than emulsified. The invention is described in relation to its preferred embodiments of emulsions. The process of the present invention involves the addition of a suitable starch to a concentrated nitrating agent, preferably concentrated nitric acid, and reacting the starch with the nitrating agent under suitable reaction conditions to thereby produce nitrostarch.

The starch may be of any suitable type, such as potato starch, corn starch or other starches known in the art suitable for the production of nitrostarch. Preferably, the starch material is in a dry powdered form to assist in distribution of the starch in the nitrating agent and also to prevent dilution of the solutions. Most preferably, redried cornstarch is used. While a gel starch may be utilized, it is not as desirable as a dry starch because it carries additional water into the reaction environment.

Nitric acid is a suitable nitrating agent for use in the process of the present invention. Other nitrating agents, such as nitrogen pentoxide, may be used. Preferably, concentrated nitric acid is utilized, that is, nitric acid of a concentration from about 80% to about 98%. Preferably, the nitric acid is about 90% to about 98%. Most preferably, the nitric acid is about 96% to about 98%. The nitrating agent does not contain any other acid. The use of nitric acid alone produces a clean, stable and desirable by-product of inorganic oxidizer salts which is utilized in the water-in-oil emulsion explosives. When a mixed acid nitrating medium is used, the spent acid solution produces undesirable by-products. For example, undesirable sulfates are produced when sulfuric acid is used as a secondary acid. Preferably, water is kept to a minimum in the nitrating agent In the preferred embodiment, the amount of nitrating agent used is in excess of the amount necessary to completely nitrate the starch. Excess nitric acid is used to make the solution convenient for processing. It has been found that about three to about twenty times the stoichiometric amount of nitrating agent per mole of starch to be nitrated should be added. Most preferably, the amount of nitrating agent utilized is sufficient to produce the desired amount of nitrostarch and is also sufficient to produce the desired amount of inorganic oxidizer salts during the subsequent treatment with a suitable neutralizing agent such as ammonium hydroxide, anhydrous ammonia, or alkali and alkaline earth metal carbonates including sodium carbonate, calcium carbonate or other suitable neutralizing agents. Preferably, about three to about fifteen times the amount of nitric acid per mole of starch to be nitrated should be used.

The starch and the nitrating agent are reacted under suitable reaction conditions to produce nitrostarch. Preferably, the process of the present invention involves stirring or agitating the nitric acid and slowly adding the starch to the nitric acid. The reaction temperature should be maintained within a suitable range by appropriate measures. Generally, the temperature of the reaction can be controlled either by controlling the rate of addition of starch and/or by cooling it with an ice-salt bath, a circulating brine bath or by similar means. The rate of addition of starch is such that the temperature of the nitrating medium remains essentially constant with minimal rise in temperature. Preferably, the reaction temperature is maintained below 40° C. by the above-described methods. More preferably, the reaction is maintained between about −10° C. to about 20° C. and most preferably between about 0° C. and about 10° C. Of course, the suitable reaction conditions, including the amount of reactants and temperatures, may be adjusted by experimentation to provide the highest possible yield of nitrostarch.

The nitration of the starch is complete about thirty (30) minutes after all the starch is added to the nitrating medium. It is preferable to then add cold water to this mixture in an amount approximately equal in weight to the amount of excess nitric acid. This addition of cold water results in a thinning of the viscous mixture of nitrostarch, acid and water, causing the nitrostarch to separate from the liquid. Thereafter, a suitable neutralizing agent is added to the reaction solution in order to neutralize the remaining nitrating agent to form inorganic oxidizer salts. Suitable neutralizing agents include ammonium hydroxide, anhydrous ammonia, and alkali and alkaline earth metal carbonates including sodium carbonate, calcium carbonate or other neutralizing agents effective to neutralize the remaining nitrating agent. Preferably, ammonium hydroxide is added to the reaction solution, or anhydrous ammonia may be bubbled through the reaction solution to neutralize the remaining acid. Ammonium hydroxide or anhydrous ammonia is preferably used because it neutralizes the remaining nitrating agent to form ammonium nitrate which is usefully employed in the resulting explosive composition. Alkali and alkaline earth metal carbonates, such as sodium carbonate or calcium carbonate added as a solid or in an aqueous solution, may be utilized to neutralize the remaining nitrating agent Because the neutralization of the solution is very exothermic, the reaction vessel should be cooled during this process. No additional water is produced in this step. The neutralization is complete when the pH of the reaction solution is about 4 as measured with litmus paper or a pH meter. The resulting aqueous solution containing dissolved oxidizer nitrate salts and nitrostarch may then be concentrated to reduce the water content to a useful level. Preferably, the amount of water is reduced such that it represents from 0% to about 15% by weight of the aqueous solution of nitrostarch and inorganic oxidizer salts. The water content may be reduced to zero, and the melted oxidizer salts, and nitrostarch and liquid fuel emulsified. These resulting compositions are commonly called melt-in-fuel emulsions.

Typically, nitrostarch should be utilized in emulsion explosives in an amount between about 5% to about 50% to achieve beneficial results, preferably between about 15% to about 30%. Also, these explosives will typically contain about 50% to about 90% inorganic oxidizer salts, preferably ammonium nitrate. Thus, one may calculate the amount of excess nitric acid needed for the nitrostarch process and the amount needed to produce the desired amount of ammonium nitrate when reacted with anhydrous ammonia Alternatively, excess nitrating agent can be utilized to react completely the amount of starch. If, after the nitration reaction, the remaining nitric acid is insufficient to provide the required amount of oxidizer for the emulsion, the solution may be augmented with solid ammonium nitrate or other oxidizing salt. This may be the case when, for example, the excess nitric acid is treated with anhydrous ammonia to produce ammonium nitrate and water such that the level of ammonium nitrate is below the amount desired in the final explosive. In this instance, solid particulate ammonium nitrate may be added and dissolved in the reaction product, thereby increasing the percentage of ammonium nitrate and avoiding the need to concentrate the solution to remove excess water. Of course, other inorganic oxidizer salts known in the art such as calcium nitrate or sodium nitrate may also be dissolved in the solution resulting from treatment with the neutralizing agent.

After concentrating the solution, the aqueous solution is then added to a carbonaceous fuel phase to form an emulsion. Prior to emulsification, the temperature of the resulting aqueous solution of nitrostarch and inorganic oxidizer salts should be such to maintain the ammonium nitrate in solution, preferably between about 75° C. and about 110° C. The carbonaceous fuel phase contains a carbonaceous fuel and an emulsifier effective to form a water-in-oil emulsion. The water-immiscible carbonaceous fuel is a flowable liquid to produce the continuous phase of the emulsion and can include most hydrocarbons, for example, paraffinic, olefinic, naphthionic, aromatic, and saturated or unsaturated hydrocarbons Suitable water-immiscible organic fuels include diesel fuel oil, mineral oil, kerosene and other petrochemical fuels, paraffinic waxes and microcrystalline waxes. Suitable oils useful in the production of the water-in-oil emulsion also include the various petroleum oils, vegetable oils, mineral oils and other petrochemical fuels known in the art. Preferably, the organic water-immiscible fuel is light mineral oil because it is inexpensive and has a relatively low viscosity. The emulsifier component useful in the process of the present invention includes any emulsifier which is effective to form a water-in-oil emulsion. Emulsifiers effective to form a water-in-oil emulsion are well-known in the art. Examples are disclosed in U.S. Pat. Nos. 3,447,978; 3,715,247; 3,765,964; and 4,141,767, the disclosures of which are hereby incorporated by reference. In addition, acceptable emulsifiers can be found in the reference work McCutcheon's Emulsifiers and Detergents (McCutcheon Division, M. C. Publishing Company, New Jersey). Preferably, monoesters of polyisobutylene succinic acid or other substituted PIBSA compounds may be used.

The two phases are combined together to form an emulsion. This can be accomplished by feeding the aqueous solution of nitrostarch and inorganic oxidizer salts and the carbonaceous fuel phase into a static mixer, a ribbon blender or other suitable emulsifying device. This will produce an emulsion matrix into which substantially uniformly dispersed void spaces may be introduced throughout in order to sensitize the matrix for enhanced detonability. Preferably, the density of emulsion explosives is controlled by using density reducing agents. Typically, the density of the explosive compositions should be from about 0.9 g/cc to about 1.45 g/cc, and preferably, from about 1.0 g/cc to about 1.40 g/cc.

The voids can be provided by void-containing or void entraining materials known in the art such as glass or resin microballoons, Saran or resin microspheres, styrofoam or perlite. The voids may also be provided by entrained gas bubbles or occluded gas generated in situ. Such gas bubbles may be whipped into the emulsion or a chemical gassing agent may be added to the emulsion matrix. In the event air or gas is whipped into the emulsion or a chemical gassing agent is added, such is preferably accomplished while emulsification is being conducted. In the event that closed cell void-containing material or void-entraining material is utilized, it is generally preferable to add these components to the emulsion matrix after it is formed to avoid crushing or damaging the void-entraining material during the emulsification step.

The emulsion explosive can also have additional components added, such as auxiliary fuels known in the art, including finely divided coal, aluminum flakes, aluminum granules, ferrophosphorous, sugar, silicon, magnesium, and sulfur. Generally, any of the fuels known may be used for purposes known in the art, e.g., bulk strength can be increased using ferrophosphorous and energy may be increased using aluminum.

EXAMPLE I

1. The formula for a small diameter emulsion explosive matrix is:

| | |
|---|---|
| Ammonium Nitrate | 74.87% |
| Sodium Nitrate | 10.26 |
| Water | 10.26 |
| Oil | 3.69 |
| Emulsifier | 1.03 |

Assume that the final desired composition is 80% explosive emulsion matrix and 20% nitrostarch.

2. The reaction for nitration of starch is:

$$2C_6H_{2}{}_{10}05 + 6HNO_3 \rightarrow C_{12}H_{14}O_4(ONO_2)_6 + 6H_2O$$

$$276\ \frac{\text{grams}}{\text{2 moles}} + 378\ \frac{\text{grams}}{\text{6 moles}} \rightarrow 594\ \frac{\text{grams}}{\text{mole}} + 108\ \frac{\text{grams}}{\text{6 moles}}$$

3. One may design a synthesis on the basis of 1 kg (1000 grams) emulsion matrix The required amount of nitrostarch then is 333.3 grams:

$$\frac{333.3}{(1000 + 333.3)} = 0.25 = 25\%$$

4. From the nitration reaction stoichiometry of step 2, one may calculate the amount of starch and nitric acid required (* signifies multiplication):

$$\text{Required Starch} = 333.3 * \frac{276}{594} = 154.9 \text{ grams}$$

$$\text{Required Acid} = 333.3 * \frac{378}{594} - 212.1 \text{ grams}$$

5. One may then calculate the excess acid required to generate 748.7 grams ammonium nitrate.

Neutralization reaction:

$$HNO_3 + NH_3 \text{ (Anhydrous)} \rightarrow NH_4NO_3$$

$$63\ \frac{\text{grams}}{\text{mole}} + 17\ \frac{\text{grams}}{\text{mole}} \rightarrow 80\ \frac{\text{grams}}{\text{mole}}$$

$$\text{Excess acid required} = 748.7 * \frac{63}{80} = 589.6 \text{ grams}$$

6. Calculate the amount of water present:

$$\text{From Nitration: } 333.3 * \frac{108}{594} = 60.6 \text{ grams water generated}$$

Water introduced with concentrated nitric acid (assume 96% nitric acid):

212.1 grams $HNO_3$ for nitration on 100% basis 589.6 grams excess $HNO_3$ for ammonium nitrate based on 100% $HNO_3$ required 801.7 grams 100% $HNO_3$ required $$\frac{801.7}{0.96} = 835.1 \text{ grams of 96\% } HNO_3 \text{ required}$$

$$835.1 - 801.7 = 33.4 \text{ grams water in concentrated } HNO_3$$

-continued $$\text{Total water present} = 60.6 + 33.4 = 94.0 \text{ grams}$$

7. Assume precipitation of nitrostarch from nitrating mixture using 500.0 grams cold $H_2O$: Total water present becomes 500.0+94.0=594.0

8. Since emulsion matrix requires 102.6 grams H20, one must evaporate:

594.0−102.6=491.4 grams $H_2O$

Evaporation temperature~=180° F.

When water content is correct, add nitrostarch/oxidizer mixture to heated (~140° F.) oil+emulsifier in the usual manner of emulsification.

When emulsification is complete, blend in glass microballoons to sensitize the emulsion (assume 2.5% required).

$$\frac{x}{1333.3 + x} = 0.25 \qquad x = 34.2 \text{ grams microballoons}$$

EXAMPLE II

Steps 1 through 4 remain unchanged.

5. Neutralization with sodium carbonate, $Na_2(CO_3)$:

$$2HNO_3 + Na_2(CO_3) \rightarrow 2NaNO_3 + CO_2 + H_2O$$

$$126 \frac{\text{grams}}{2 \text{ moles}} \quad 106 \frac{\text{grams}}{\text{mole}} \rightarrow 170 \frac{\text{grams}}{2 \text{ moles}} + 44 \frac{\text{grams}}{\text{mole}} + 18 \frac{\text{grams}}{\text{mole}}$$

Calculate the amount of excess $HNO_3$ required to generate 102.6 grams $NaNO_3$:

Grams excess $HNO_3$=102.6 *

$$\frac{\frac{126}{2}}{\frac{170}{2}}$$

=76.0 grams acid

Calculate the amount of $Na_2(CO_3)$ required to neutralize 76.0 grams $HNO_3$:

Grams $Na_2(CO_3)$=76.0 *

$$\frac{106}{126} =$$

=64.0 grams $Na_2(CO_3)$ required

6. Quench nitration, neutralize, and precipitate nitrostarch with solution of 64 grams $Na_2(CO_3)$ in 300 grams $H_2O$. Add slowly with cooling to control exothermicity.

7. Calculate the total amount of water present:

From nitrating acid=

$$\frac{212.1}{0.96}$$

−212.1=8.8 grams $H_2O$

From nitration=60.6 grams $H_2O$

From excess acid=

$$\frac{76.0}{0.96}$$

−76.0=3.2 grams $H_2O$

From neutralization=64.0 *

$$\frac{18}{106}$$

=10.2 grams $H_2O$

From neutralizing solution=300 grams

Total water present=382.8 grams

8. After neutralization is complete, add 748.7 grams ammonium nitrate, heat and evaporate:

382.8−102.6=280.2 grams $H_2O$

Complete emulsification as in Example I

EXAMPLE III

Steps 1 through 4 remain unchanged.

5. Neutralization with concentrated $NH_4OH$ solution.

$HNO_3 + NH_4OH \rightarrow NH_4NO_3 + H_2O$ $$63 \frac{\text{grams}}{\text{mole}} + 35 \frac{\text{grams}}{\text{mole}} \rightarrow 80 \frac{\text{grams}}{\text{mole}} + 18 \frac{\text{grams}}{\text{mole}}$$

The amount of excess acid to generate 748.7 grams ammonium nitrate is 589.6 grams (See Example I, step 5).

Calculate the amount of $NH_4OH$ required to neutralize 589.6 grams $HNO_3$:

Grams $NH_4OH$=589.6 *

$$\frac{35}{63}$$

=327.6 grams

Use a cold 60% solution of $NH_4OH$ added slowly with additional cooling.

The amount of $NH_4OH$ required for the solution is:

$$\frac{327.6}{0.60}$$

=546.0 grams $NH_4OH$ solution

6. Calculate the total amount of water present as in Example II, step 7:

From nitrating acid=8.8 grams $H_2O$

From nitration=60.6 grams $H_2O$

From excess acid=

$$\frac{589.6}{0.96}$$

−589.6=24.6 grams $H_2O$

From neutralization=327.6 *

$$\frac{18}{35}$$

=168.5 grams $H_2O$

From neutralizing solution=546.0 * 0.40=218.4 grams $H_2O$

Total water present=480.9 grams

7. Add 102.6 grams sodium nitrate after neutralization, heat and evaporate.

480.9−102.6=378.3 grams $H_2O$

Complete emulsification as in Example I.

One skilled in the art will recognize that it is possible to make the compositions of the present invention utilizing a variety of materials and by making slight variations to the process of the present invention. While the preferred embodiments of the present invention have been described in detail, it will be evident that various further modifications are possible without departing from the scope of the invention.

I claim:

1. A process for the manufacture of a water-in-oil emulsion containing nitrostarch, comprising:
(a) combining starch with a nitrating agent;
(b) maintaining said starch and nitrating agent in contact under suitable reaction conditions for a sufficient period to allow nitration of said starch to produce a mixture containing nitrostarch and nitrating agent;
(c) contacting said mixture of nitrostarch and nitrating agent with a neutralizing agent to produce a solution containing nitrostarch, dissolved inorganic oxidizer salts, and water; and
(d) combining the aqueous solution of nitrostarch and dissolved inorganic oxidizer salts with a carbonaceous fuel and an emulsifier to form a water-in-oil emulsion.

2. The method of claim 1 further comprising the step of concentrating the solution of step (c) to reduce the amount of water.

3. The method of claim 1 further comprising the step of adding additional oxidizer to the solution of step (c).

4. The method of claim 1 further comprising the step of adding density reducing agents throughout said water-in-oil emulsion to render said emulsion detonable.

5. The method of claim 4 further comprising the step of adding auxiliary fuels to said water-in-oil emulsion.

6. A method in accordance with claim 1 wherein said nitrating agent is nitric acid.

7. A method in accordance with claim 1 wherein said nitrating agent is about 80% to about 98% nitric acid.

8. A method in accordance with claim 1 wherein said nitrating agent is present from about 3 moles to about 20 moles per mole of starch to be nitrated.

9. A method in accordance with claim 1 wherein said nitrating agent is present from about 3 moles to about 15 moles per mole of starch to be nitrated.

10. A method in accordance with claim 1 wherein the starch utilized is dry powdered starch.

11. A method in accordance with claim 1 wherein the neutralizing agent utilized produces ammonium nitrate.

12. A process for the manufacture of a water-in-oil emulsion containing nitrostarch, comprising:
(a) combining starch with nitric acid;
(b) maintaining said starch and nitric acid in contact under suitable reaction conditions for a sufficient period to allow nitration of said starch to produce a mixture of nitrostarch and nitric acid;
(c) contacting said mixture of nitrostarch and nitric acid with a neutralizing agent to produce a solution containing nitrostarch, dissolved inorganic oxidizer salts, and water; and
(d) combining the aqueous solution of nitrostarch and dissolved inorganic oxidizer salts with a carbonaceous fuel and an emulsifier to form a water-in-oil emulsion.

13. The step of claim 12 further comprising the step of concentrating the solution of step (c) to reduce the amount of water.

14. The method of claim 12 further comprising the step of adding additional oxidizer to the solution of step (c).

15. The method of claim 12 further comprising the step of adding density reducing agents throughout said water-in-oil emulsion to render said emulsion detonable.

16. The method of claim 15 further comprising the step of adding auxiliary fuels to said water-in-oil emulsion.

17. The method of claim 12 wherein said nitric acid is about 90% to about 98%.

18. A method in accordance with claim 12 wherein said nitric acid is present from about 3 moles to about 20 moles per mole of starch to be nitrated.

19. A method in accordance with claim 12 wherein the nitric acid is present from about 3 moles to about 15 moles per mole of starch to be nitrated.

20. A method in accordance with claim 12 wherein the starch utilized is dry powdered starch.

21. A method in accordance with claim 12 wherein the neutralizing agent utilized produces ammonium nitrate.

22. A process for the manufacture of a water-in-oil emulsion containing nitrostarch, comprising:
(a) slowly adding starch to an excess amount of nitric acid;
(b) maintaining said starch and nitric acid in contact under suitable reaction conditions for a sufficient period to allow nitration of said starch to produce a mixture of nitrostarch and nitric acid;
(c) contacting said mixture of nitrostarch and nitric acid with a neutralizing agent to produce a solution containing nitrostarch, dissolved inorganic oxidizer salts, and water; and
(d) combining the aqueous solution of nitrostarch and dissolved inorganic oxidizer salts with a carbonaceous fuel and an emulsifier to form a water-in-oil emulsion.

23. The step of claim 22 further comprising the step of concentrating the solution of step (c) to reduce the amount of water.

24. The method of claim 22 further comprising the step of adding additional oxidizer to the solution of step (c).

25. The method of claim 22 further comprising the step of adding density reducing agents throughout said water-in-oil emulsion to render said emulsion detonable.

26. The method of claim 25 further comprising the step of adding auxiliary fuels to said water-in-oil emulsion.

27. The method of claim 22 wherein said nitric acid is about 96% to about 98%.

28. A method in accordance with claim 22 wherein said nitric acid is present from about 3 moles to about 20 moles per mole of starch to be nitrated.

29. A method in accordance with claim 22 wherein said nitric acid is present from about 3 moles to about 15 moles per mole of starch to be nitrated.

30. A method in accordance with claim 22 wherein the starch utilized is dry powdered starch.

31. A method in accordance with claim 22 wherein the neutralizing agent utilized produces ammonium nitrate.

32. A process for the manufacture of an emulsion containing nitrostarch consisting essentially of:
(a) slowly adding dry powdered starch to an excess amount of nitric acid;
(b) agitating and maintaining the temperature of step (a) between about −10° C. to about 20° C.;
(c) maintaining said starch and nitric acid in contact under the conditions of step (b) for a sufficient period to allow nitration of said starch to produce a mixture of nitrostarch and nitric acid;
(d) contacting the mixture of nitrostarch and nitric acid of step (c) with a neutralizing agent to produce a solution containing nitrostarch, dissolved ammonium nitrate and water;

(e) adjusting the amount of water in said solution of nitrostarch dissolved ammonium nitrate and water of step (d) from 0% to about 15% of the weight of said solution; and (f) combining the aqueous solution of nitrostarch and dissolved ammonium nitrate with a carbonaceous fuel and an emulsifier to form an emulsion.

33. The method of claim 32 wherein the amount of water in the solution of step (e) is adjusted from 0% to about 15% of the weight of said solution by concentrating said solution.

34. The method of claim 32 wherein the amount of water in the solution of step (e) is adjusted from 0% to about 15% of the weight of said solution by adding additional oxidizer to said solution.

35. The method of claim 32 further comprising the step of adding density reducing agents throughout said emulsion to render said emulsion detonable.

36. The method of claim 35 further comprising the step of adding auxiliary fuels to said emulsion.

37. The method of claim 32 wherein said nitric acid is about 96% to about 98%.

38. A method in accordance with claim 32 wherein said nitric acid is present from about 3 moles to about 20 moles per mole of starch to be nitrated.

39. A method in accordance with claim 32 wherein said nitric acid is present from about 3 moles to about 15 moles per mole of starch to be nitrated.

40. A process for the manufacture of an emulsion explosive containing nitrostarch, comprising:

(a) slowly adding starch to an excess amount of nitric acid without other acids;

(b) maintaining the starch and nitric acid in contact under suitable reaction conditions for a sufficient period to allow nitration of the starch to produce a mixture of nitrostarch and nitric acid;

(c) contacting said mixture of nitrostarch and nitric acid with a neutralizing agent to produce a solution containing nitrostarch, dissolved inorganic oxidizer salts and water;

(d) adjusting the amount of water in said solution of nitrostarch, dissolved inorganic oxidizer salts and water of step (c) from 0% to about 15% of the weight of said solution;

(e) combining the aqueous solution of nitrostarch and dissolved inorganic oxidizer salts with a carbonaceous fuel and an emulsifier to form an emulsion; and (f) adding density reducing agents throughout said emulsion of step (c) to render said emulsion detonable.

41. A method in accordance with claim 40 wherein the amount of water in the solution of step (d) is adjusted from 0% to about 15% of the weight of said solution by concentrating said solution.

42. A method in accordance with claim 40 wherein the amount of water in the solution of step (d) is adjusted from 0% to about 15% of the weight of said solution by adding additional oxidizers to said solution.

43. The method of claim 42 further comprising the step of adding auxiliary fuels to said emulsion.

44. The method of claim 40 wherein said nitric acid is about 90% to about 98%.

45. A method in accordance with claim 40 wherein the nitric acid is present from about 3 moles to about 20 moles per mole of starch to be nitrated.

46. A method in accordance with claim 37 wherein said nitric acid is present from about 3 moles to about 15 moles per mole of starch to be nitrated.

47. A method in accordance with claim 40 wherein the starch utilized is dry powdered starch.

48. A method in accordance with claim 40 wherein the neutralizing agent utilized produces ammonium nitrate.

* * * * *

UNITED STATES PATENT AND TRADEMARK OFFICE

CERTIFICATE OF CORRECTION

PATENT NO. : 4,980,000

DATED : December 25, 1990

INVENTOR(S) : Sohara

It is certified that error appears in the above-identified patent and that said Letters Patent is hereby corrected as shown below:

Column 2, line 36, delete "and, water" and insert therefore --and water--.

Column 2, line 36, after "and" insert --,--.

Column 2, line 54, delete "therefrom The" and insert therefore --therefrom. The--.

Column 2, line 63, delete "e.g." and insert therefore --e.g.--.

Column 4, line 23, delete "agent Because" and insert therefore --agent. Because--.

Column 4, line 36, after "salts," delete "and".

Column 4, line 48, after "ammonia" insert --.--.

Column 5, lines 11-12, after "hydrocarbons" insert --.--.

Column 5, line 29, delete "McCutcheon's Emulsifiers and Detergents" and insert therefore --McCutcheon's Emulsifiers and Detergents--.

Column 5, line 47, delete "void entraining" and insert therefore --void-entraining--.

Column 5, line 50, delete "in situ" and insert therefore --in situ--.

Column 5, line 68, delete "e.g." and insert therefore --e.g.--.

UNITED STATES PATENT AND TRADEMARK OFFICE

CERTIFICATE OF CORRECTION

PATENT NO. : 4,980,000

DATED : December 25, 1990

INVENTOR(S) : Sohara

It is certified that error appears in the above-identified patent and that said Letters Patent is hereby corrected as shown below:

Column 6, line 38, delete "-" and insert therefore --=--.

Column 7, line 43, after "grams" insert --excess--.

Column 7, line 49, before "64.0" delete "=".

Signed and Sealed this

Seventh Day of July, 1992

*Attest:*

*Attesting Officer*

DOUGLAS B. COMER

*Acting Commissioner of Patents and Trademarks*